US006182399B1

(12) United States Patent
Pollera

(10) Patent No.: US 6,182,399 B1
(45) Date of Patent: Feb. 6, 2001

(54) GUTTER WING SYSTEM

(76) Inventor: Arthur Pollera, 54 E. Gate Rd., Massapequa Park, NY (US) 11762

( * ) Notice: Under 35 U.S.C. 154(b), the term of this patent shall be extended for 0 days.

(21) Appl. No.: 09/330,693

(22) Filed: Jun. 11, 1999

(51) Int. Cl.[7] ..... E04D 13/00

(52) U.S. Cl. ..... 52/11; 52/14; 52/12; 248/48.2; 248/48.1

(58) Field of Search ..... 52/11, 12, 14, 52/15; 248/48.1, 48.2

(56) References Cited

U.S. PATENT DOCUMENTS

| | | | | |
|---|---|---|---|---|
| 2,841,100 | | 7/1958 | Moller . | |
| 2,851,969 | | 9/1958 | Teutsch . | |
| 3,091,055 | | 5/1963 | Hegedusich . | |
| 4,669,232 | * | 6/1987 | Wyatt | 52/11 |
| 4,757,649 | | 7/1988 | Vahldieck . | |
| 5,170,596 | | 12/1992 | Zadok . | |
| 5,274,965 | | 1/1994 | Jackson . | |
| 5,752,347 | * | 5/1998 | Osborn | 52/11 |
| 5,893,239 | * | 4/1999 | Leahy | 52/11 |
| 5,896,706 | * | 4/1999 | Pike | 52/11 |

* cited by examiner

*Primary Examiner*—Christopher T. Kent
*Assistant Examiner*—Jennifer I. Thissell
(74) *Attorney, Agent, or Firm*—Hoffmann & Barron, LLP

(57) ABSTRACT

A gutter wing system is described, which includes a gutter wing and a collection tube which rotate about a support arm in an automatic cycle between a closed position and an open position to collect and redirect run-off water from the roof of a building, through a trough, while rejecting leaves and other debris from the system.

15 Claims, 9 Drawing Sheets

GUTTER WING SYSTEM

BACKGROUND OF THE INVENTION

The present invention relates generally to gutter systems, and more particularly to a gutter wing system for receiving water run-off from a roof in preference to debris.

Gutter systems have long been used to divert rain water run-off from the roofs of structures. Typically, gutter systems include a length of some sort of trough which collects the run-off and redirects it to a down spout and thereby away from the structures. Unfortunately, along with the rain water, these prior art systems also collect leaves and other debris which runs off the roof This problem causes gutters to fill up with leaves and other debris so that the amount of water which can be redirected is significantly reduced. The gutter cannot redirect water at all when the gutter becomes altogether blocked. In either case, the water run-off overflows from the gutter, rendering the gutter partially or totally useless, exposing the building structure to damage from the undirected water.

Prior art devices address this problem by providing gutter systems which enable the user to empty the gutter manually, thereby restoring its water-diverting capability. For example, U.S. Pat. No. 5,274,965, to Jackson, discloses a rigid gutter which is mounted upon an L-shaped flange. The gutter is hinged to a bracket at its outside lower corner and includes a cord which allows the user to rotate the entire gutter, outwardly, such that the gutter becomes inverted and spills its contents to the ground. These devices do nothing to protect the gutter from the accumulation of debris and furthermore do not redirect leaves and other debris.

Other devices provide a mesh or screen covering to keep the trough free of large debris by allowing water to pass through the screen. An example is U.S. Pat. No. 2,841,100 to Moller. These devices, however, also require the user to manually clear the obstruction caused by accumulated debris and therefore do not provide for the redirection of debris away from the gutter system. For that matter, smaller size debris (i.e., less than the mesh size of the screen) is not kept out of the trough.

Some devices include a trough with a solid cover. U.S. Pat. No. 4,757,649 to Vahldieck provides a horizontally extended cover that relies on the capillary action of the water to cause it to adhere to the curved end of the cover and run into the gutter while supposedly allowing debris to fall off and miss the gutter. However, the Vahldieck gutter does not provide a complete cover to the gutter and, as such, still permits debris to enter the gutter. In addition, the cover included in the Vahldieck gutter is not able to open up to allow access to the trough for a heavy flow of water.

Finally, U.S. Pat. No. 2,851,969 to Teutsch discloses a trough which includes a hinged cover which rotates from a closed position, where the cover lies over the trough and against the roof surface, to an open position, where the trough is fully exposed. The cover includes a receptacle at its outer edge to collect water and thereby rotate the cover into the open position. However, because the cover lies against the roof, and not below the roof, all water flowing off the roof flows into the collection receptacle. Therefore, the gutter is unable to keep the trough covered during low water flow, because the cover will rotate open even in light water flow. Also, this system does not allow the water accumulated in the collection receptacle to drain into the trough. Rather, when the cover opens, the accumulated water must empty directly to the ground. Therefore, the trough is unable to divert a large portion of the water run-off, markedly undermining its efficiency and exposing the building structure to damage from the water run-off.

It would be desirable to provide a gutter system which is capable of collecting and diverting water run-off from the roof of a building while automatically protecting the gutter from the collection of leaves and other debris.

SUMMARY OF THE INVENTION

The present invention provides a novel gutter wing system for mounting adjacent an edge of a roof for receiving run-off water from the roof in preference to debris. The gutter system includes a system support pan which has an inner wall, for mounting against a surface of a structure adjacent to and substantially parallel with the edge of the roof, and a bottom trough which is continuous with the inner wall and which is sufficiently horizontal to divert water there along. The gutter system also includes a support arm which is fixed to the bottom trough and extends vertically from the bottom trough to support a water-diverting wing/collection tube for receiving run-off water from the roof while preventing the collection of debris in the bottom trough.

In one embodiment of the present invention, the support arm includes a mounting portion, a pivoting portion and a hinge located between the mounting portion and the pivoting portion. In the preferred embodiment the mounting portion is fixably attached to the bottom trough and includes a mounting plate located on an underside of the bottom trough, by conventional means.

The pivoting portion is preferably dimensioned to be accepted by a correspondingly shaped female portion of the water-diverting wing/collection tube, the pivoting portion preferably being rectangular in cross section and the female portion being a substantially rectangular shaped slot integral to the water-diverting wing/collection tube and including a front wall, a top wall and a rear wall.

Either the pivoting portion or the rear wall of the female portion may include a locking protrusion which is dimensioned to fit within a corresponding opening in the other of the rear wall or the pivoting portion. The rear wall of the female portion is flexible so that the rear wall may engage or disengage the locking protrusion. The rear wall may also include a tab, which is a continuous extension of the rear wall away from the pivoting portion to facilitate flexing of the rear wall for engagement or disengagement of the locking protrusion.

In an alternative embodiment the hinge may be a living hinge formed between the mounting portion and the pivoting portion by a reduced mass portion of a continuous body of the support arm. The hinge biases the pivoting portion of the support arm in an upright position. In another alternative embodiment the hinge includes first and second cooperating hinge parts, and a spring assembly. The first and second cooperating hinge parts are integral to the mounting portion and pivoting portion respectively and are mounted about a spring assembly which includes a pin and one or more springs. The one or more springs are mounted at the end of the pivoting portion and mounting portion, adjacent a cooperating hinge part, and secured to the support arm by a pin which extends through the one or more springs and each cooperating hinge part. Each of the one or more springs contact both the mounting portion and the pivoting portion such that the pivoting portion is biased in the upright position. In still another alternative embodiment the cooperating hinge parts are affixed to the mounting portion and pivoting portion respectively and are joined to each other about the spring assembly. The spring assembly is mounted such that the one or more springs contact the cooperating hinge parts and bias the pivoting portion of the support arm in an upright position.

In another alternative embodiment of the present invention, the support arm may be integral to the system support pan and include a continuous wall that extends upward from the system support pan ending in a rounded pivot which is dimensioned to fit within a corresponding socket integral to the underside of the water-diverting wing/collection tube.

The gutter system also includes a water-diverting wing/collection tube mounted on the support arm for rotation thereabout. The water-diverting wing/collection tube includes a wing portion which has a sloped surface extending upwardly from the support arm and rearwardly toward the inner wall, and a collection tube which receives run-off water from the wing portion and directs it along its length to the bottom trough. The water-diverting wing/collection tube has a body with a cross sectional dimension substantially equal to the cross sectional dimension of the bottom trough. The water-diverting wing/collection tube is in a closed position, such that run-off water from the roof is directed to the collection tube, until the weight of the water collected in the collection tube drives the collection tube downwardly toward the bottom trough causing the water-diverting wing/collection tube to rotate about the support arm to an open position where the water in the collection tube empties into the bottom trough and run-off water falls directly from the roof into the bottom trough.

In the preferred embodiment of the present invention the wing portion extends from a point immediately below the edge of the roof to a point substantially just above the collection tube, its cross section a compound curve which permits run-off water to be directed to the collection tube and released from the surface of the wing portion above the collection tube. The wing portion may include a slight depression in the surface of the wing, which forms a water collection concavity. It may also include a counterweight which is removably affixed to a surface of the wing portion by conventional means.

The collection tube includes a continuous wall that forms an open tube, the opening of which is at a point below the wing portion such that the collection tube receives run-off water from the surface of the wing portion but precludes any debris from entering.

In another alternative embodiment of the gutter wing system the system support pan includes an integral system fastening segment located on an underside of the bottom trough for mounting the system support pan to the surface of the structure.

As a result of the present invention there is now provided a gutter wing system which receives and diverts run-off water from a roof in preference to debris, automatically, and without the requirement of the user to manually clear the gutter, which prevents the gutter from becoming filled up with leaves and debris such that it loses its water diverting capabilities. There is also provided a gutter system which completely covers a trough during a light run-off condition while allowing access to the trough during a heavy run-off condition and which diverts all run-off water, that it receives, to the trough. There is also provided a gutter system with a water-diverting wing/collection tube that is removably affixed to a support arm to allow the user access to the trough and which includes a counterweight system to allow adjustment of the rotation of the water-diverting wing/collection tube. There is also provided a gutter wing system which is mountable to the face of a structure by conventional means external to the trough.

For a better understanding of the present invention, together with other and further advantages, reference is made to the following description, taken in conjunction with the accompanying drawing, and its scope will be pointed out in the appended claims.

DESCRIPTION OF THE DRAWINGS AND APPENDIXES

DETAILED DESCRIPTION OF THE PREFERRED EMBODIMENTS

Figure 1:
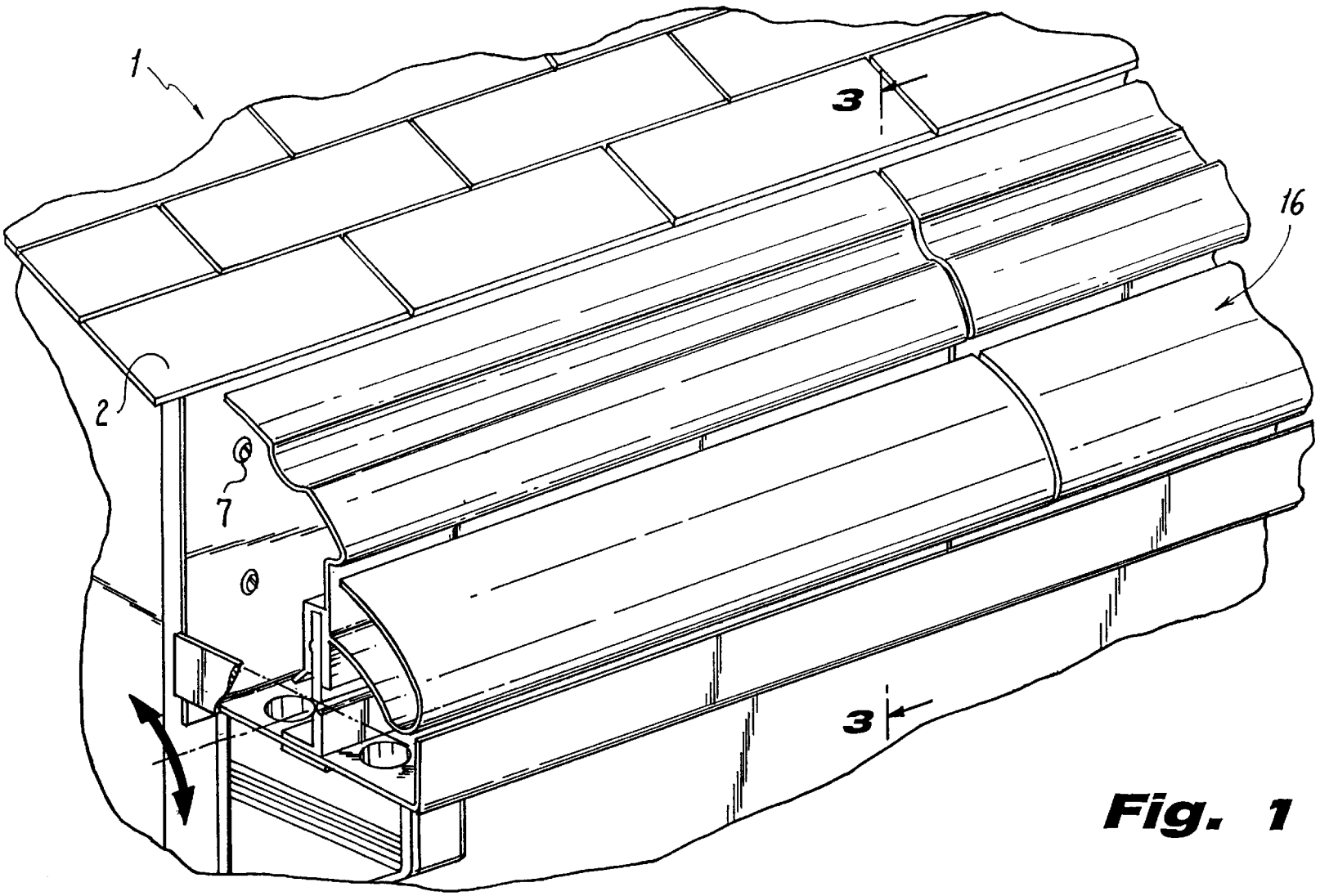
FIG. 1 is a perspective view of a gutter wing system of the present invention.

As seen in FIG. 1, a novel gutter wing system 1 is secured to a face of a structure and extends parallel to and below an edge of a roof 2 of the structure, in a "closed" position, such that the gutter wing system 1 collects any rain water running off the roof 2 while rejecting leaves and other debris.

Figure 2:
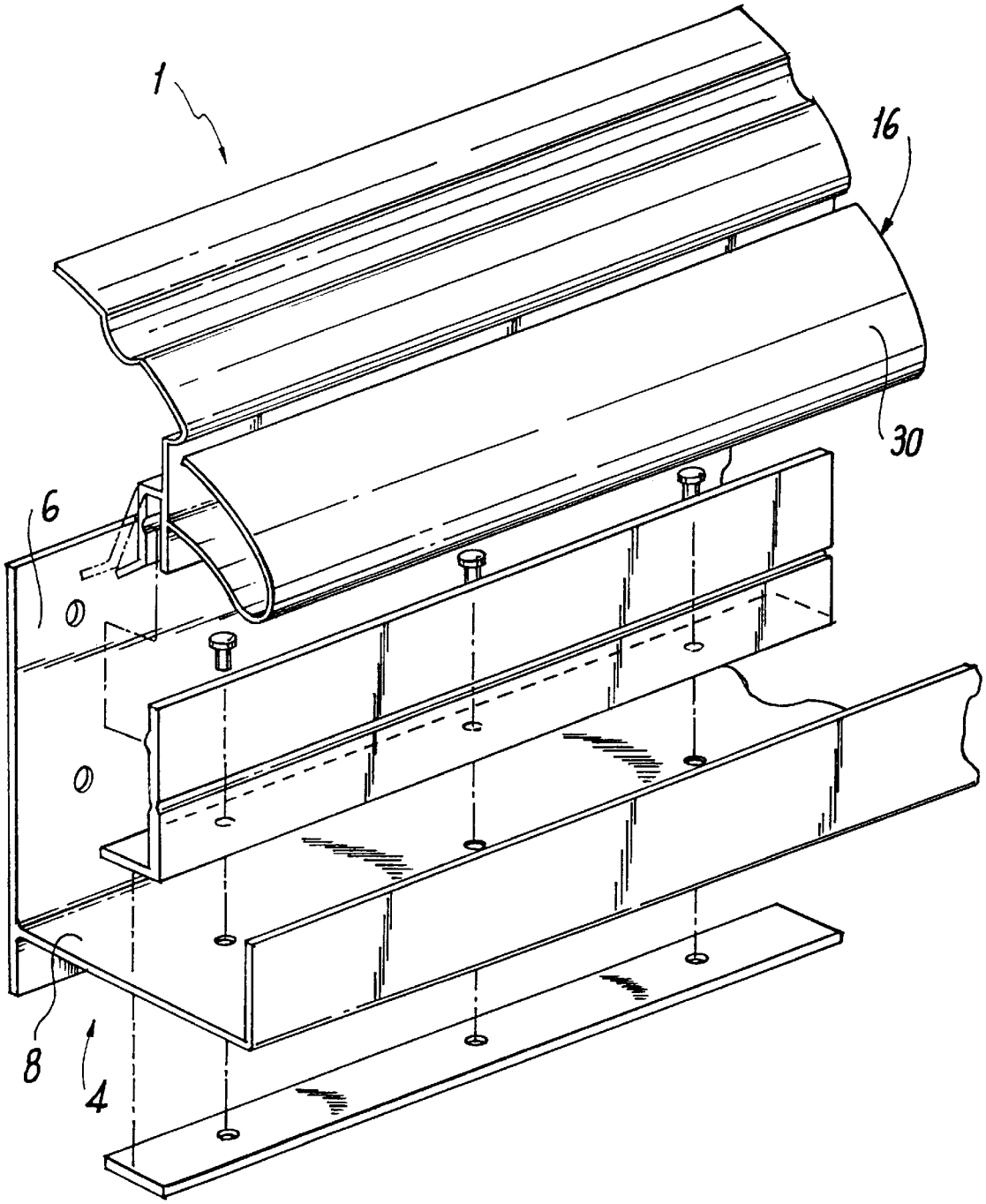
FIG. 2 is an exploded perspective view, similar to FIG. 1, of a gutter wing system illustrating a support arm and mounting plate.

As shown in FIG. 2, the gutter wing system 1 includes a system support pan 4 which is defined by an inner wall 6 and a bottom trough 8. As more clearly illustrated in FIG. 3, the gutter wing system 1 is preferably fastened to a face of a structure by conventional fastening means, such as screws or spikes 7 through the inner wall 6. In one embodiment of this invention, additional fastening of the gutter wing system 1 to the face of the structure may also be provided through an integral system fastening segment 12 which is located on an underside of bottom trough 8 below and continuous with the inner wall 6.

In the following detailed description the various embodiments of the gutter wing system will be described with reference to various contoured surfaces of the gutter wing system components. In this context the term "upward" refers to a direction opposite the bottom trough and generally skyward. The term "downward" refers to a direction opposite the roof edge and generally toward the ground. The term "inward" refers to a direction toward the face of the structure and the inner wall. The term "outward" in this description refers to a direction generally opposite the inner wall of the gutter wing system and the face of the structure.

Inner wall 6 and bottom trough 8 comprise a continuous wall, inner wall 6 being oriented against the face of the structure. The bottom trough 8 extends substantially horizontal from the bottom of inner wall 6, outward to a point just beyond the outer most portion of a collection tube 30 which will be described below. The outermost portion is directed upwardly to form a trough.

Figure 3:
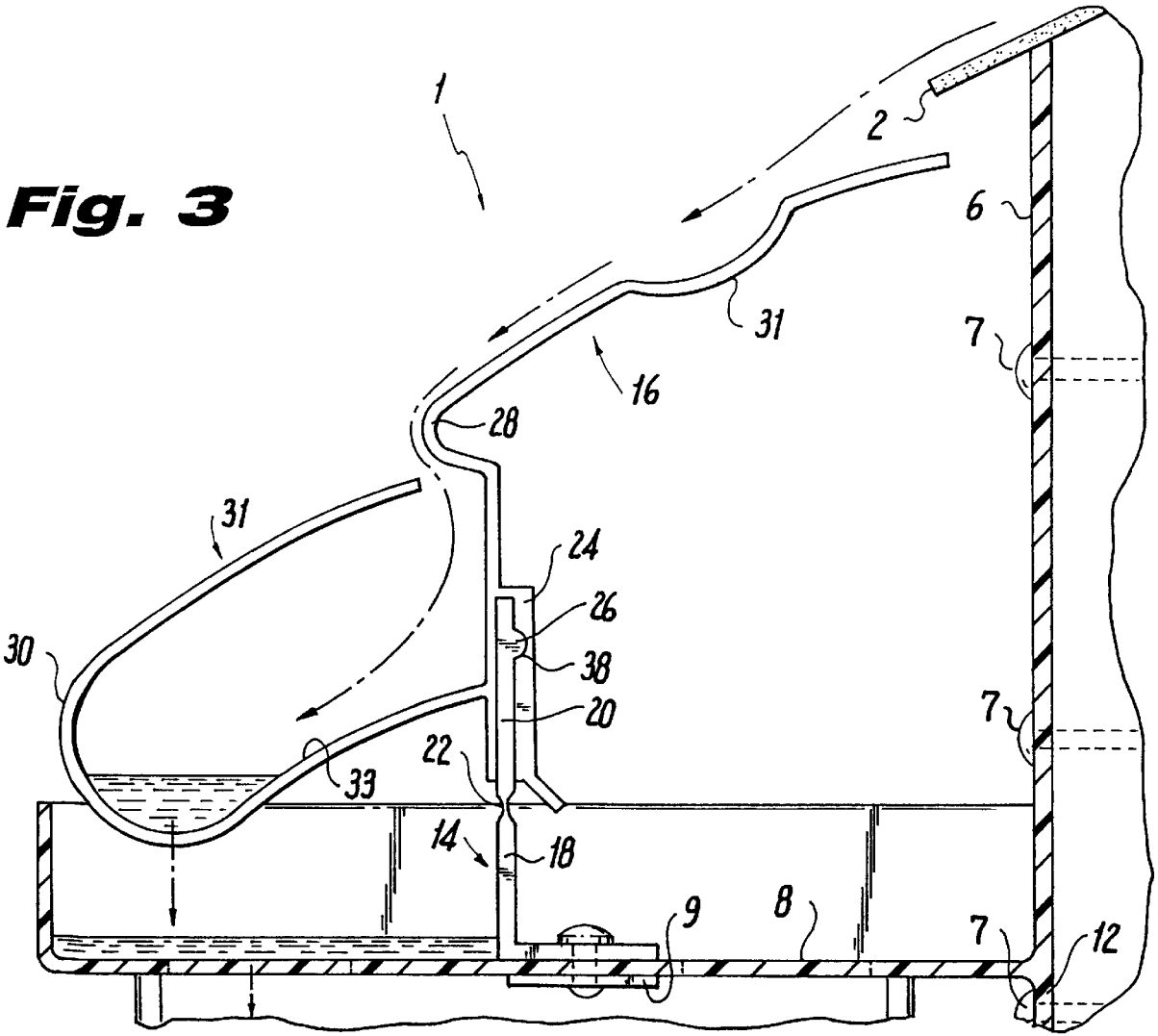
FIG. 3 is a side elevational view of a gutter wing system of FIG. 1 in a closed position.

In FIG. 3, a support arm 14 is seen attached to bottom trough 8 to provide a support for a water-diverting wing/collection tube 16. Support arm 14 includes a mounting portion 18 affixed to bottom trough 8 by conventional means; a pivoting portion 20 on which water-diverting wing/collection tube 16 is mounted; and a hinge 22 about which the water-diverting wing/collection tube 16 rotates. Mounting of support arm 14 to bottom trough 8 is preferably made through a mounting plate 9 which extends along the length of and on the underside of system support pan 4 opposite support arm 14. Pivoting portion 20 is preferably a generally rectangularly shaped member dimensioned to be accepted by a corresponding female portion 24 of the water-diverting wing/collection tube 1, both of which are described below in detail. Either of the pivoting portion 20 or female portion 24 include a locking protrusion 26 which is dimensioned to engage and fit within a corresponding opening 38 within the other of the female portion 24 or pivoting portion 20.

Hinge 22 is, in one preferred embodiment, a living hinge, as shown in FIG. 3, between pivoting portion 20 and mounting portion 18. This arrangement allows the water-diverting wing/collection tube 16 to rotate about mounting portion 18. The hinge 22 is formed of a reduced mass portion of a continuous body of support arm 14 between the pivoting portion 20 and mounting portion 18 and biases mounting portion 18 in an upright position such that the water-diverting wing/collection tube 16 remains in a closed position when the hinge 22 is in the relaxed condition.

Figures 9, 10:
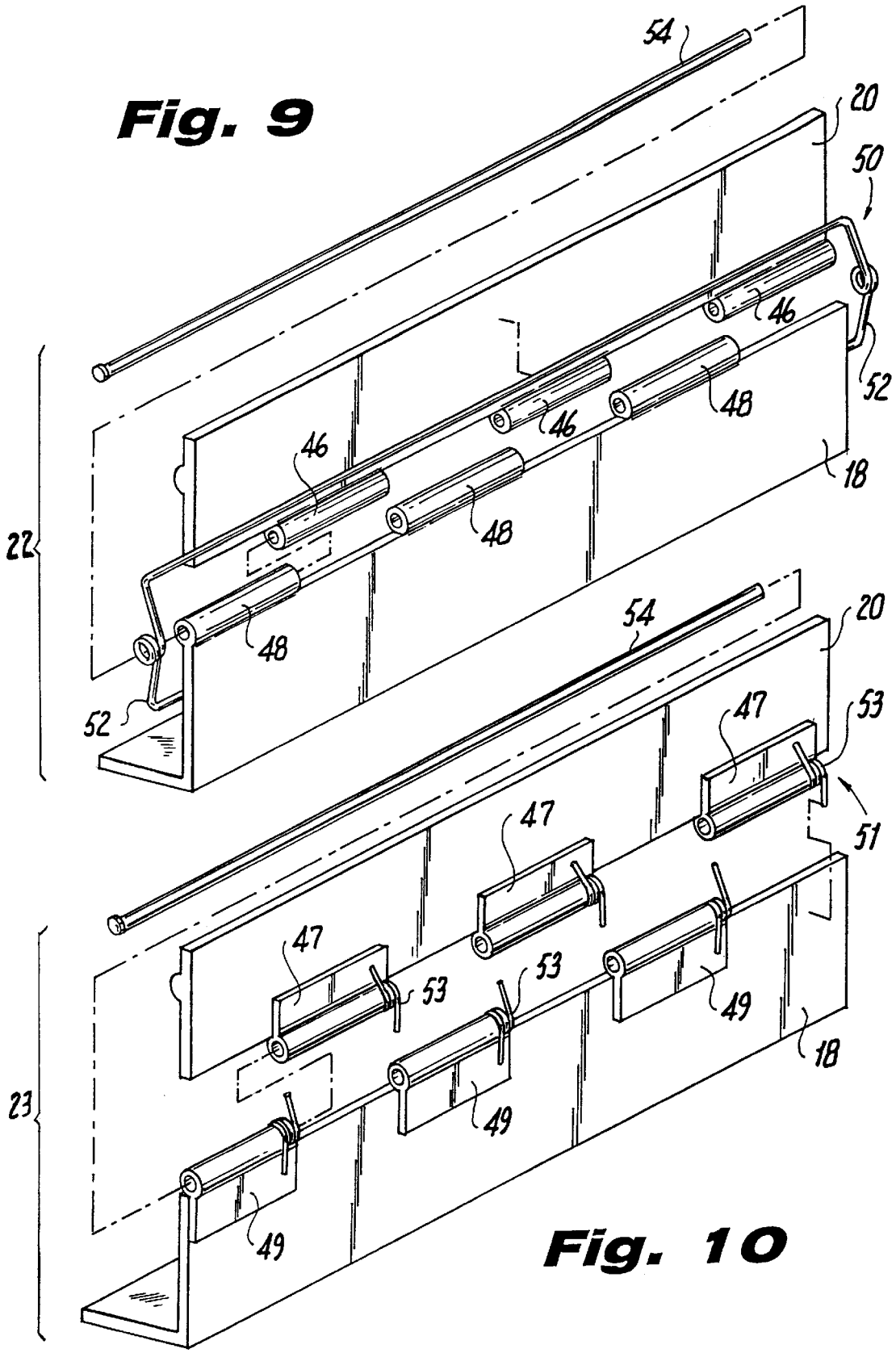
FIG. 9 is a perspective view of an alternative gutter wing system illustrating a hinge, including first and second cooperating hinge parts integral to the support arm and a spring assembly.
FIG. 10 is similar to FIG. 9 except the cooperating hinge parts are individually mounted on the support arm.

FIG. 9 shows an alternative embodiment of the present invention wherein hinge 22 is formed of first and second cooperating hinge parts 46,48 integral to pivoting portion 20 and mounting portion 18 respectively and mounted integral with spring assembly 50. Spring assembly 50 includes one or more springs 52 mounted about a pin 54 at at least one end of water-diverting wing/collection tube such that springs 52 contact opposite sides of pivoting portion 20 and mounting portion 18 and bias pivoting portion 18 in the upright (i.e., closed) position. Pin 54 extends through cooperating hinge parts 46,48 and springs 52.

Alternatively, as depicted in FIG. 10, hinge 23 may include first and second cooperating hinge parts 47,49 individually affixed to pivoting portion 20 and mounting portion 18, respectively, about a spring assembly 51 by conventional means. Spring assembly 51 includes one or more springs 53 mounted about pin 54. The one or more springs 53 are interspaced between and contact the cooperating hinge parts 47,49 thereby biasing the pivoting portion 20 in an upright position, such that the water-diverting wing/collection tube 16 is in a closed position. Pin 54 extends through cooperating hinge parts 47,49 and the one or more springs 53.

Figure 5:
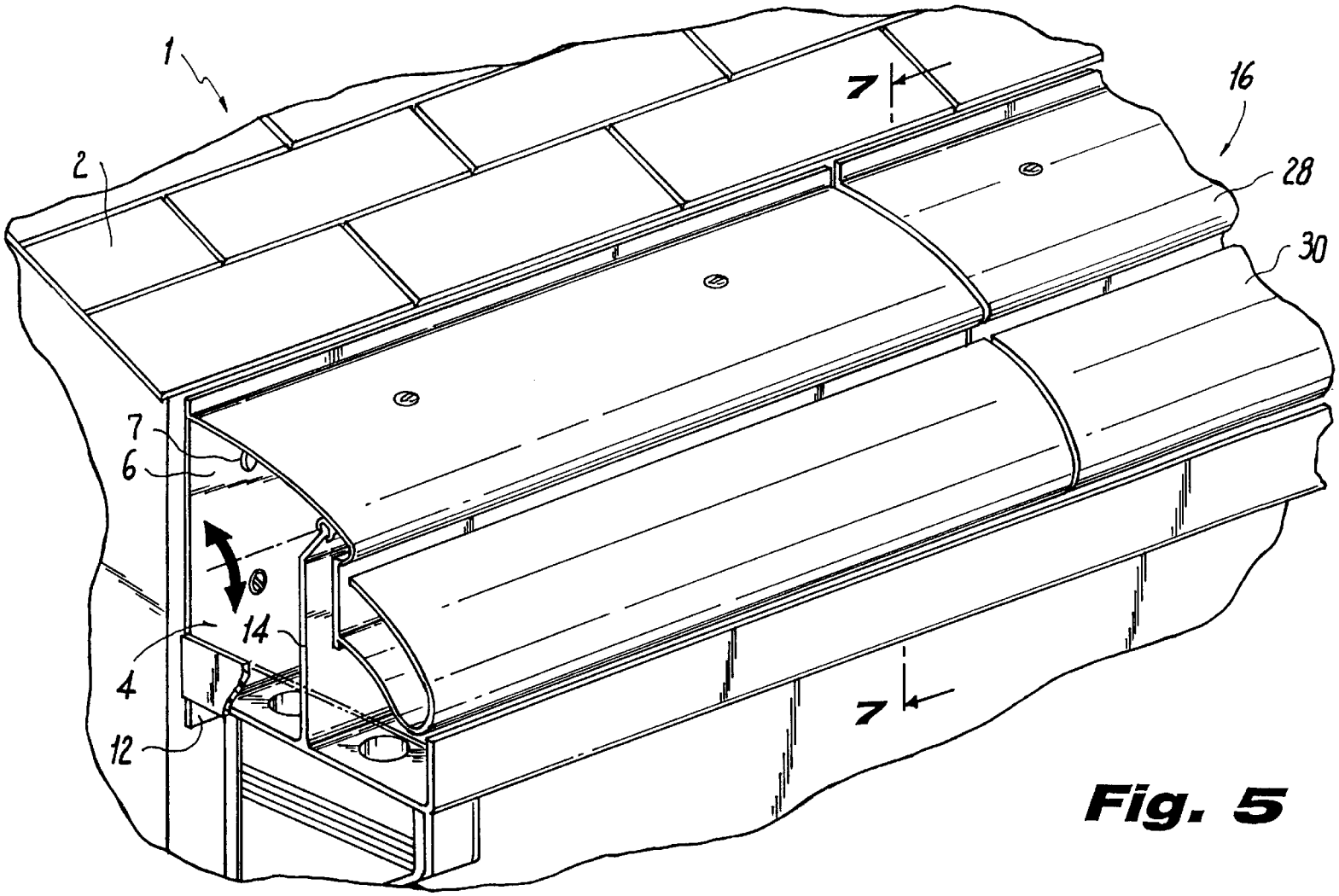
FIG. 5 is a perspective view of an alternative embodiment of the gutter wing system of the present invention.
Figure 7:
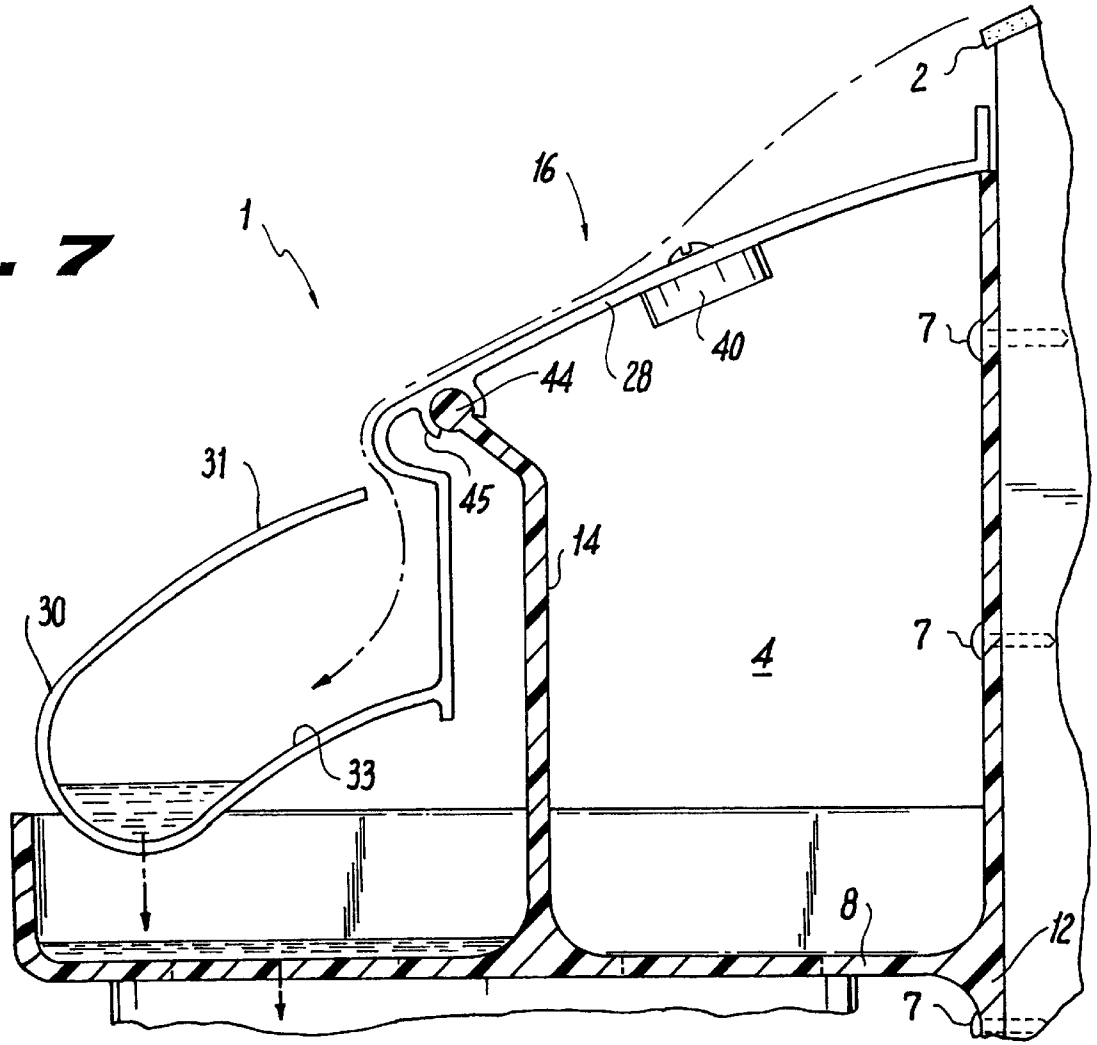
FIG. 7 is a side elevational view of the alternative gutter wing system shown in FIG. 5.
Figure 8:
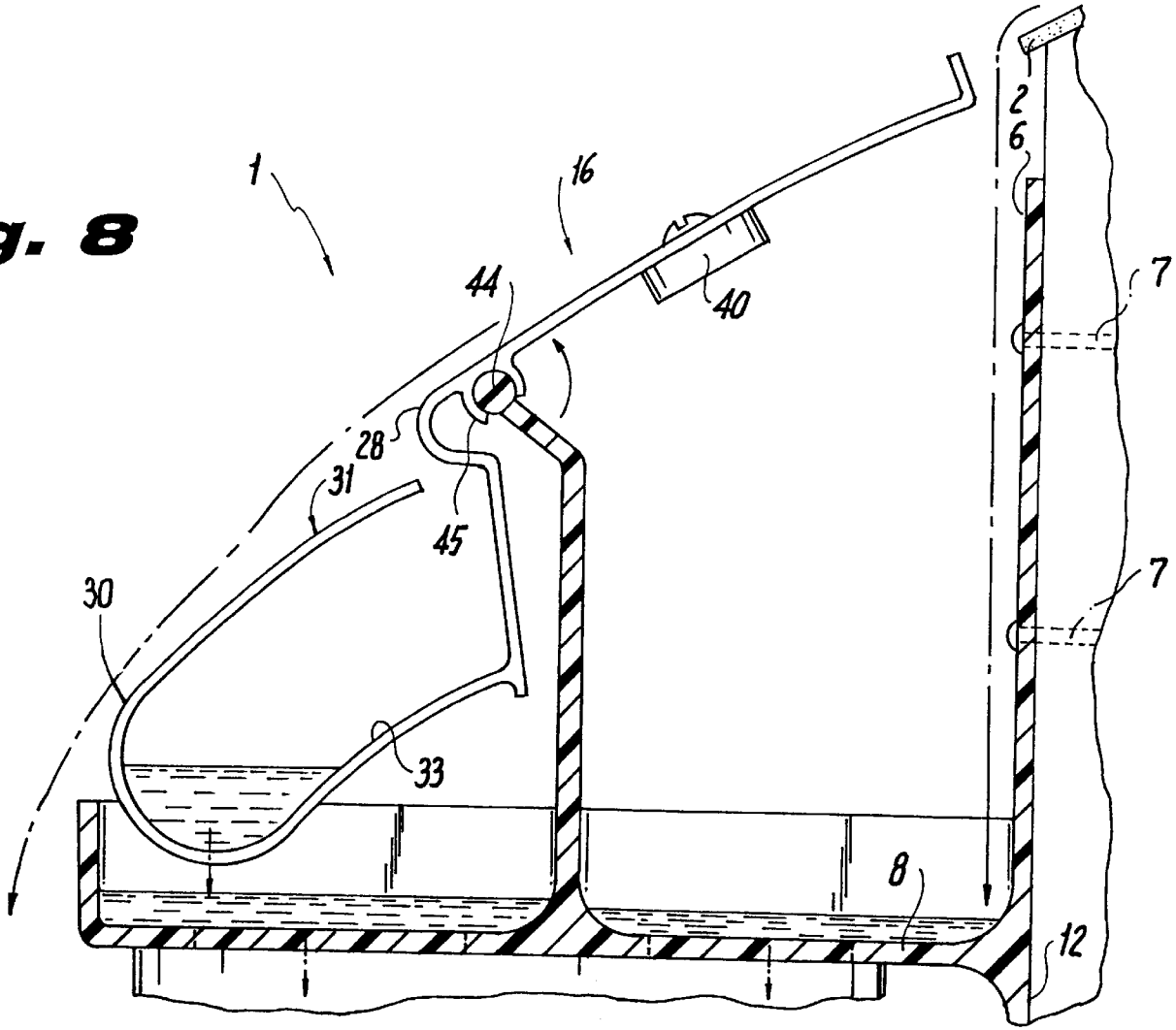
FIG. 8 is similar to FIG. 7 and depicts the water-diverting wing/collection tube in an open position.

In another alternative embodiment of the present invention, illustrated in FIG. 5, support arm 14 and system support pan 4 are each part of a singular integral member. As shown more clearly in FIGS. 7 and 8, support arm 14, extends upward from the support pan 4, and ends in a rounded pivot 44 which is dimensioned to fit within a corresponding socket 45 integral to the water-diverting wing/collection tube 16. The rounded pivot 44 allows the water-diverting wing/collection tube 16 to be removably mounted on support arm 14 and to rotate thereabout, between closed and open positions.

Figure 4:
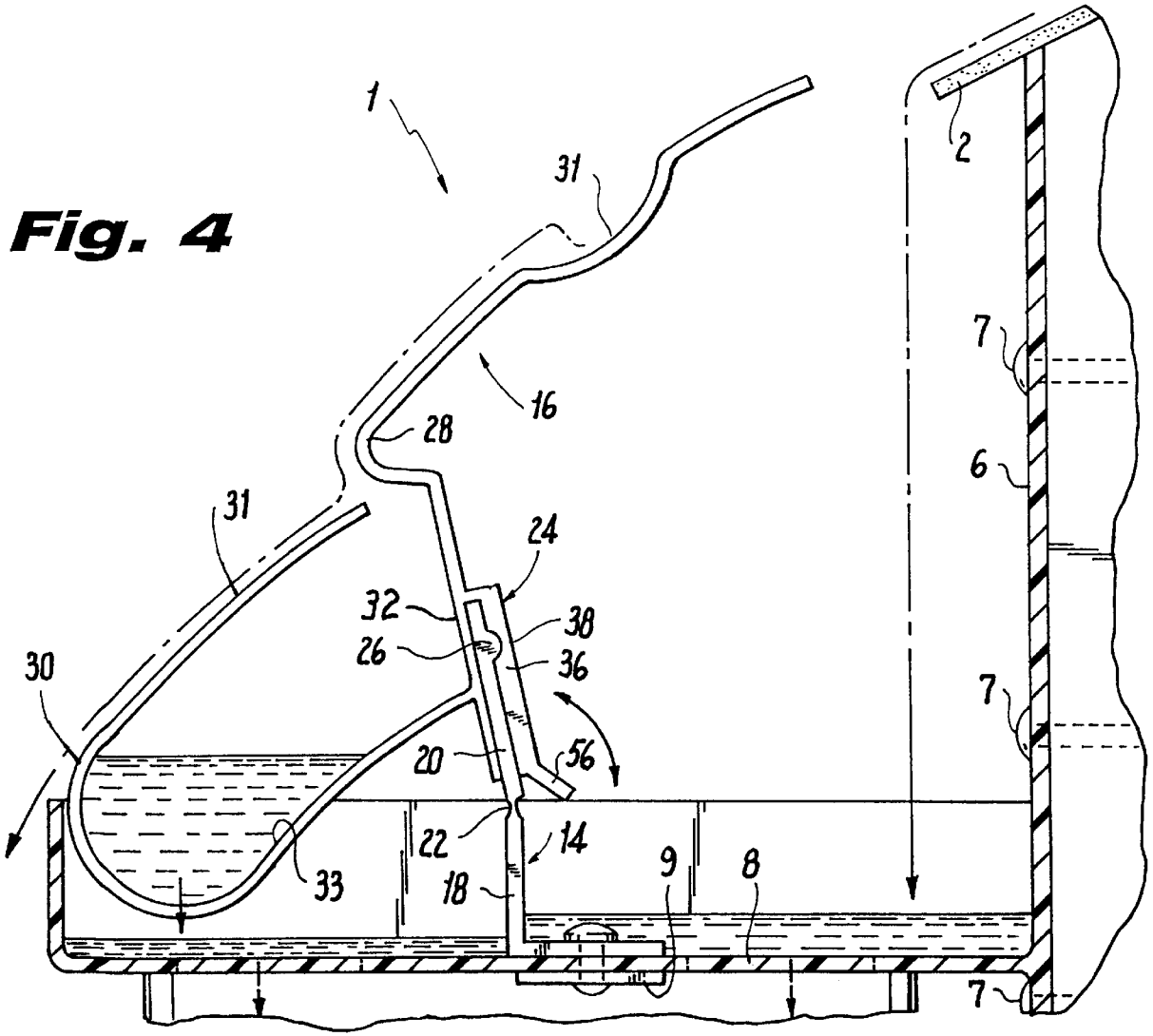
FIG. 4 is similar to FIG. 3 except the gutter wing system is shown in an open position.

As illustrated in FIG. 4, the water-diverting wing/collection tube 16 includes a wing portion 28, hereinafter referred to as a wing, and a collection tube 30. The water-diverting wing/collection tube 16 is a continuous member with the wing 28 and collection tube 30 joined about a female portion 24. Female portion 24, is a substantially rectangular shaped slot including a front wall 32; a top wall 34; and a rear wall 36, and is dimensioned to accept pivoting portion 20 such that the water-diverting wing/collection tube 16 is mounted atop pivoting portion 20 and thereby support arm 14. Rear wall 36 may include an opening 38 dimensioned to accept locking protrusion 26 thereby removably securing water-diverting wing/collection tube 16 to support arm 14. The rear wall 36 of female portion 24 is flexible to allow the engagement and disengagement of locking protrusion 26 into opening 38 and may include an integral tab 56 it the end of rear wall 36 which extends away from the pivoting portion 20 to facilitate flexing of the rear wall 36 to allow the engagement or disengagement of locking protrusion 26 with opening 38. Front wall 32 defines the juncture of wing 28 and collection tube 30.

As shown in FIG. 3, wing 28 is preferably a continuous surface which extends generally upwardly and rearward of female portion 24. Wing 28 begins by extending horizontally outward away from front wall 32 of mounting slot 24, curving upwardly and inward, in a compound curve which has a radius that increases until the wing 28 extends generally upward and inward, toward the roof 2 of said structure.

Wing 28 extends toward the roof 2, forming a slope which is preferably concave to system support pan 4 and ends below the edge of roof 2, defining the closed position of the gutter wing system. In this position, water and debris flowing off the roof 2 will flow over the wing 28 toward the collection tube 30, the operation of which will be described below, rather than into support pan 4.

In an alternative embodiment of the present invention, wing 28 includes a water collection concavity 31 located in the sloped portion of wing 28 to facilitate the temporary collection of run-off water and to act as a counterweight to keep the gutter wing system 1 in a closed position until the weight is overcome by the weight of water collected in collection tube 30, the details of which will be described below.

Figure 6:
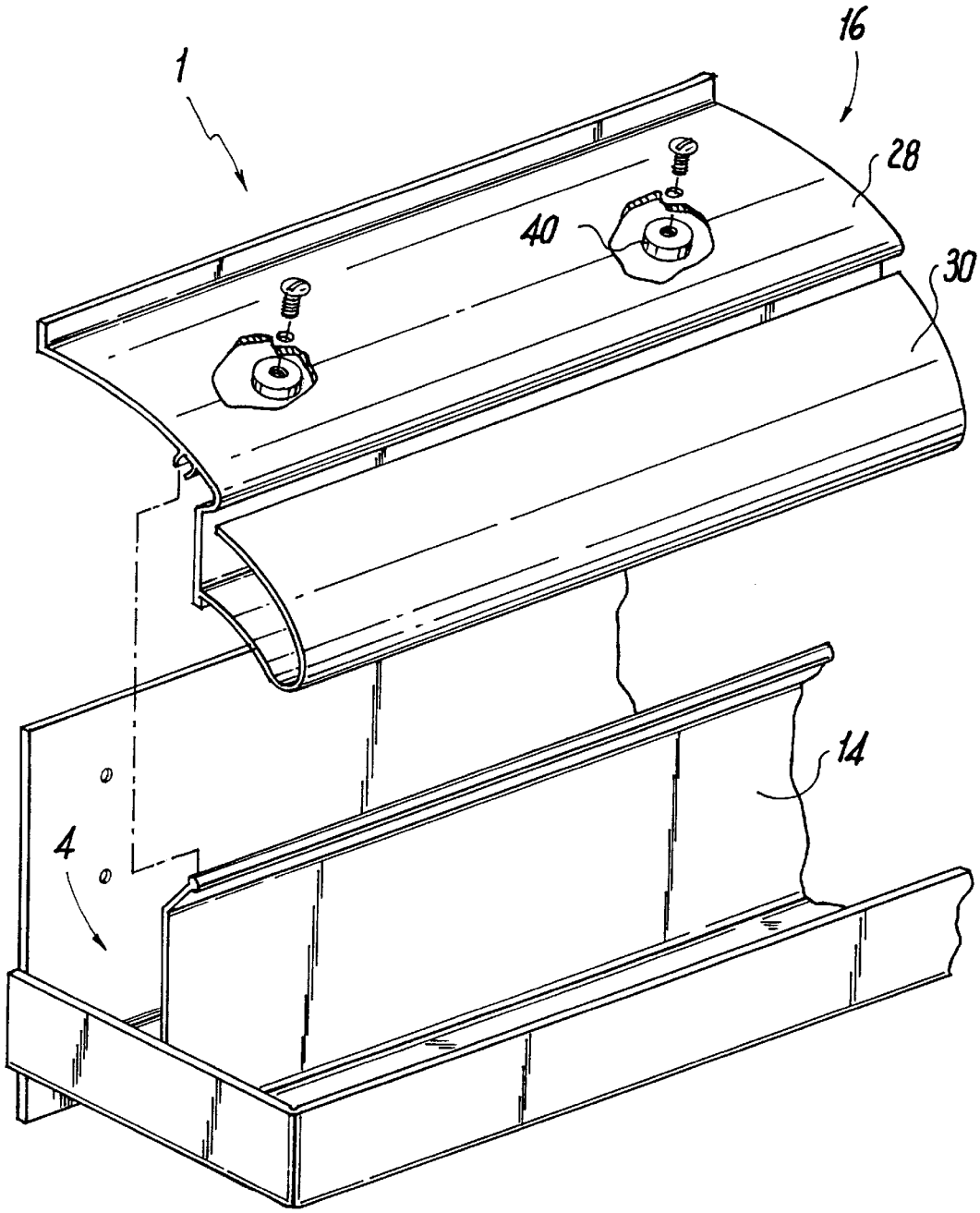
FIG. 6 is similar to FIG. 5 and illustrates the mounting of a water-diverting wing/collection tube and a counter weight.

In another alternative embodiment of this invention, shown in FIG. 6, the aforementioned counterweight action may be provided by a physical counterweight 40 attached to the sloped portion of wing 28, by conventional means. Counterweight 40 may be adjustable to account for changing weather conditions such as high wind or accumulation of snow or ice or to adjust the cycling rate of the water-diverting wing/collection tube 16.

Collection tube 30 preferably is a continuous wall which is integral with the front wall of mounting slot 24 forming an open tube. Collection tube 30 initially extends outwardly, above the outer edge of system support pan 4, in a generally downward slope. At its lowest point, collection tube 30 extends in a complex curve, the radius of the curve increasing such that the collection tube 30 curves rearwardly and upward until it forms a plane substantially parallel to the bottom portion 33 of the wall and such that collection tube 30 substantially covers that portion of bottom trough 8 which extends outward of support arm 14. Collection tube 30 ends somewhat lower and inward of the outermost portion of wing 28, the opening 38 of the collection tube 30 lying below the wing 28. In this configuration debris which falls off wing 28 will thereby fall onto the upper outer surface 31 of collection tube 30 and continue over the bottom trough and away from the gutter system 1.

In operation, water-diverting wing/collection tube 16 is initially in a closed position as illustrated in FIG. 3. Run-off water and debris which flow off the edge of a roof 2 fall onto wing 28. Because of the wing's 28 sloped orientation, both water and debris travel down the wing 28 away from the structure. Run-off water on the surface of the gutter wing system will adhere to the compound curve of the wing 28 and fall into collection tube 30, and thereafter drain out of the end of collection tube 30 into bottom trough 8. However, debris falling with the water, off of roof 2, will not flow into collection tube 30, but rather will fall from wing 28 onto the surface of the concave portion of collection tube 30 and continue over the edge of bottom trough 8 and fall onto the ground. Additionally, any rain water which falls directly onto outer surface 31 of collection tube 30 or which is carried, with debris, onto the outer surface 31 either splashes or flows out of the system and harmlessly to the ground away from the structure or adheres to the compound curve of collection tube 30 and falls into bottom trough 8.

In a heavier run-off condition, enough water collects in collection tube 30 to overcome the counterweight of wing 28. As a result, the water-diverting wing/collection tube 16 pivots, outward, as a single member about support arm 14, to the open position sufficiently to permit the water collected in collection tube 30 to drain into bottom trough 8. During this period, the flow of rain falls as run off directly into bottom trough 8. As soon as the collected water empties out of collection tube 30, the weight of wing 28 automatically causes the water-diverting wing/collection tube 16 to rotate, clockwise as depicted herein, about support arm 14 back to the closed position. This cycle will be repeated as long as run-off rain water is sufficiently rapid to cause collection of a volume of water which rotates the water-diverting wing/collection tube 16.

While the principles of the invention have now been made clear in illustrated embodiments, it will be clear to those skilled in the art that many modifications of structure, arrangement and components can be made which are particularly adapted for specific environment and operating requirements without departing from those principles. The appended claims are, therefore, intended to cover and embrace any such modifications, within the limit only within the true spirit and scope of the invention.

What is claimed is:

1. A gutter system for mounting adjacent an edge of a roof for receiving run-off water therefrom in preference to debris, said gutter system comprising:

(a) a system support pan having;

(i) an inner wall for mounting against a surface of a structure adjacent to and substantially parallel with an edge of a roof of said structure, and (ii) a bottom trough continuous with said inner wall and oriented sufficiently horizontal to divert water there along;

(b) a support arm fixed to said bottom trough and extending vertically therefrom at a distance to support a water-diverting gutter wing/collecting tube for receiving run-off water from said roof while preventing collection of debris in said trough; and (c) a water-diverting wing/collection tube mounted on said support arm for rotation thereabout, and having;

(i) a wing portion which has a sloped surface extending upwardly from said support arm and rearwardly toward said inner wall, and (ii) a collection tube which receives run-off water from said wing portion and directs it along its length to said bottom trough at ends of said tube, said water-diverting wing/collection tube having a body with a cross sectional dimension substantially equal to said bottom trough, whereby run-off water from said roof is directed to said collection tube while said water-diverting wing/collection tube is in a closed position until weight of said water collected in said collection tube drives said collection tube downwardly toward said bottom trough thereby rotating said water-diverting wing/collection tube to an open position whereby water empties into said bottom trough and run-off water falls directly into said bottom trough.

2. A gutter wing system as in claim 1 wherein said support arm comprises a first mounting portion, a second pivoting portion, and a hinge therebetween, said mounting portion being fixably attached to said bottom trough by conventional fastening means through a mounting plate and said water-diverting wing/collection tube being removably mounted on said pivoting portion.

3. A gutter wing system as in claim 2 wherein said pivoting portion is dimensioned to be received by a correspondingly shaped female portion of said water-diverting wing/collection tube.

4. A gutter wing system as in claim 3 wherein said pivoting portion is rectangular in cross section and said female portion is a substantially rectangular-shaped slot, integral to said water-diverting wing/collection tube, dimensioned to accept said second pivoting portion, said slot including a front wall, a top wall and a rear wall.

5. A gutter wing system as in claim 4 wherein one of said pivoting portion and said rear wall of said female portion includes a locking protrusion dimensioned to fit within a corresponding opening in the other of said pivoting portion and said rear wall of said female portion, said rear wall being flexible such that said rear wall may disengage said locking protrusion.

6. A gutter wing system as in claim 5 wherein said rear wall of said female portion includes a tab comprising a continuous extension of said rear wall, away from said pivoting portion such that said rear wall may be flexed to engage or disengage said locking protrusion.

7. A gutter wing system as in claim 2 wherein said hinge is a living hinge, formed by a reduced mass portion of the continuous body of said support arm between said mounting portion and said pivoting portion, which biases said pivoting portion in an upright position.

8. A gutter wing system as in claim 2 wherein said hinge comprises first and second cooperating hinge parts, and a spring assembly, said first and second cooperating hinge parts being mounted to said mounting portion and said pivoting portion respectively and joined to each other about said spring assembly, said spring assembly mounted to bias said pivoting portion in an upright position.

9. A gutter wing system as in claim 8 wherein said cooperating hinge parts are integrally formed with said mounting portion and said pivoting portion respectively.

10. A gutter wing system as in claim 1 wherein said support arm comprises a continuous wall, integral to said system support pan, extending upward therefrom and ending in a rounded pivot dimensioned to fit within a corresponding socket which is integral to said wing portion, such that said water-diverting wing/collection tube is removably mounted upon and rotates about said pivot between said closed position and said open position.

11. A gutter wing system as in claim 1 wherein said wing portion extends from a point immediately below said roof to a point substantially just above said collection tube and has a cross-section which is a compound curve permitting run-off water to be directed to said collection tube and released from said surface of said wing portion above said collection tube.

12. A gutter wing system, as in claim 11, wherein said wing portion includes a slight depression in said sloped surface, to form a water collection concavity.

13. A gutter wing system, as in claim 11, wherein said wing portion includes a counter-weight, removably affixed to said sloped surface thereof by conventional means.

14. A gutter wing system as in claim 1 wherein said collection tube comprises a continuous wall forming an open tube, said opening being at a point below said wing portion which permits receipt of run-off water from a surface of said wing portion and precludes entry of debris.

15. A gutter wing system as in claim 1 wherein said system support pan includes an integral system fastening segment on an underside of said bottom trough, whereby said system support pan may be mounted to said surface of said structure.

* * * * *